US006920974B2

(12) United States Patent
Reynolds et al.

(10) Patent No.: US 6,920,974 B2
(45) Date of Patent: Jul. 26, 2005

(54) BLISTER PACKAGE STORAGE AND DISPENSING CONTAINER AND METHOD

(75) Inventors: Ger Reynolds, Wexford (IE); Trevor O'Neill, Waterford (IE)

(73) Assignee: Bausch & Lomb Incorporated, Rochester, NY (US)

( * ) Notice: Subject to any disclaimer, the term of this patent is extended or adjusted under 35 U.S.C. 154(b) by 0 days.

(21) Appl. No.: 10/606,704

(22) Filed: Jun. 26, 2003

(65) Prior Publication Data

US 2004/0262186 A1 Dec. 30, 2004

(51) Int. Cl.[7] ..... A45C 11/04

(52) U.S. Cl. ..... 206/5.1; 206/443; 206/804; 414/416.12

(58) Field of Search ..... 206/5.1, 443, 804, 206/815, 428; 414/416.12

(56) References Cited

U.S. PATENT DOCUMENTS 1,286,810 A * 12/1918 Sheppard ..... 206/443
2,195,369 A * 3/1940 Innes ..... 221/31
2,669,380 A * 2/1954 Grenier ..... 206/521.1
4,434,890 A * 3/1984 Sieck et al. ..... 206/443
6,044,966 A 4/2000 Haase

* cited by examiner

*Primary Examiner*—Bena Miller
(74) *Attorney, Agent, or Firm*—Craig E. Larson

(57) ABSTRACT

Apparatus and method for inexpensively storing a quantity of packages awaiting transfer to a manufacturing process station includes a dispenser for quickly removing the packages from the container and directly into a secondary receptacle which is particularly adapted for feeding the packages to the process station. The provision of an inexpensive container to hold the packages is advantageous in that the more expensive secondary receptacles are not tied up for the sole purpose of holding packages which are awaiting the next process station.

11 Claims, 1 Drawing Sheet

BLISTER PACKAGE STORAGE AND DISPENSING CONTAINER AND METHOD

BACKGROUND OF THE INVENTION

The present invention generally relates to material handling, and more particularly relates to an improved container and method for storing and dispensing disposable blister packages, especially in a manufacturing environment.

SUMMARY OF THE INVENTION

In a first aspect, the invention comprises a container incorporating one or more discrete columns for holding a plurality of stacked blister packages therein, respectively. The container is especially useful for storing a quantity of blister packages in a holding area prior to advancing to a subsequent manufacturing process station. The container is adapted for quick dispensing of the blister packages therefrom, and is particularly adapted for quick transfer of the blister packages from the container to a secondary receptacle or tower used for feeding the blister packages to a process station (e.g., a cartoning machine). Since the container of the invention is used solely for holding product while awaiting transfer to a subsequent process station, the container may be formed from a relatively inexpensive material such as cardboard and the like so that more expensive package dispensing towers, such as those used to feed the blisters to the subsequent process station, are not required to hold the packages that are waiting to be processed. Although the invention is not so limited, the blister packages may be of the disposable type used for storing and shipping contact lenses in a storage solution to the consumer.

DETAILED DESCRIPTION

Figure 1:
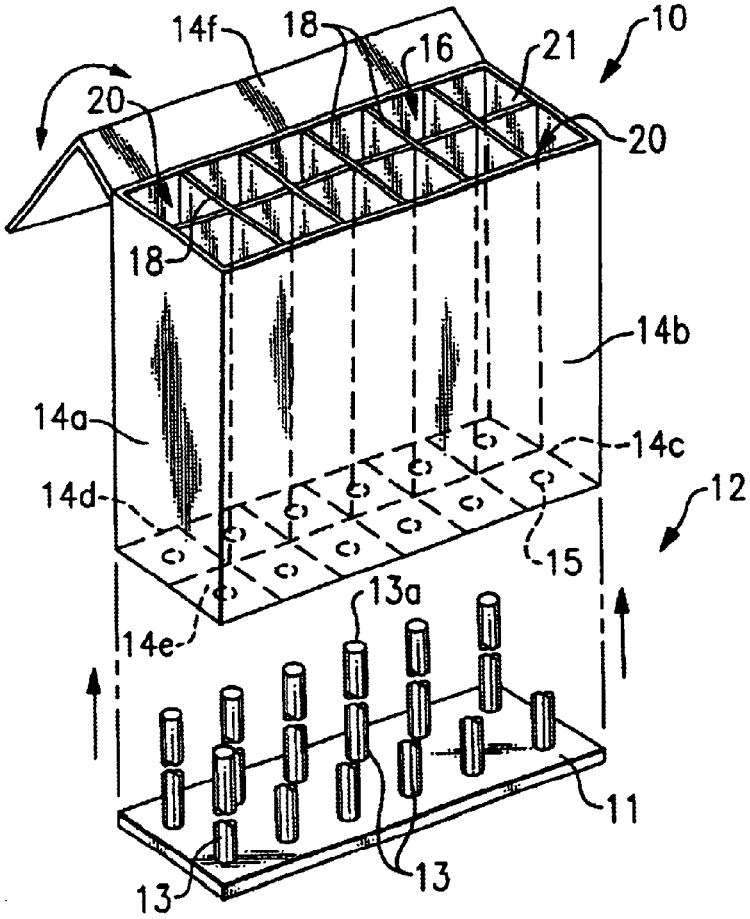
FIG. 1 is a perspective view of one embodiment of the container of the invention.

Referring to the drawing, there is seen in FIG. 1 a representative embodiment of the invention generally comprising a container 10 and a package dispenser 12. Container 10 has a generally box-like configuration with four side panels 14*a*–14*d*, a bottom panel 14*e* and optional top panel 14*f*, all defining an interior 16. Other shapes and configurations for container 10 are within the scope of the invention and the configuration shown here is for purposes of discussion only.

One or more dividing panels 18 are provided in container interior 16 to define one or more but preferably an array of parallel, open columns 20 extending in an uninterrupted fashion from bottom panel 14*e* to the upper, open end 21 of container 10. Although the invention is shown and described herein with a total of 12 separate columns arranged in a 6×2 array, it is understood that any number of columns (i.e., one or more) may be utilized as desired to realize the benefits of the invention.

Figure 2:
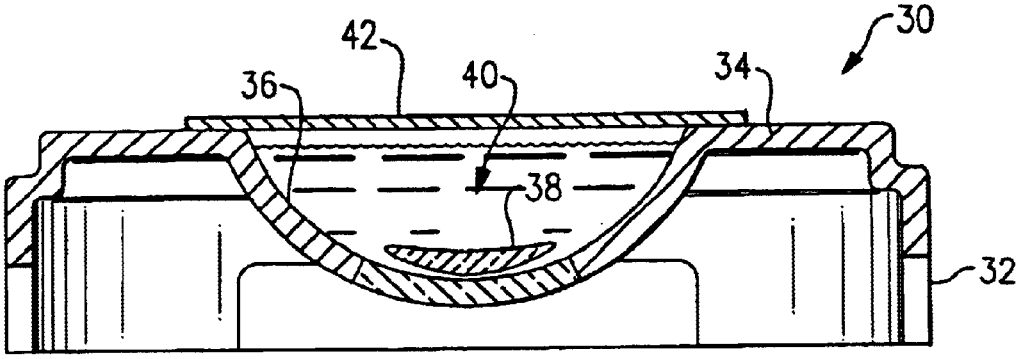
FIG. 2 is a perspective view of a blister package with which the invention may be utilized.

As discussed in the Summary, container 10 is used to store a plurality of stacked blister packages for storage thereof between sequential process stations in a manufacturing environment where the blister packages are to be used as the final package for a product (e.g., a contact lens). In FIG. 2, a blister package 30 includes side walls 32 and top surface 34 wherein a well 36 is formed for holding a contact lens 38 and quantity of storage solution 40 therein, and sealed by a lidtock 42 affixed to top surface 34. Such a contact lens package may be seen in U.S. Pat. No. 6,044,966 incorporated herein by reference. It is understood, however, that the invention may be conformed and used with any configuration of package desired. A plurality of such blister packages 30 may be stacked upon each other and placed in a column 20 of container 10 until each column is full of stacked blister packages. The container 10 is thus useful for storing a large quantity of blister packages between process stations.

In a high speed contact lens manufacturing operation, a quantity of packaged contact lenses may require storage in a holding area prior to being sent to a cartoning machine (not shown) which deposits the blister packages into a secondary carton for shipping to the retail store or end-user of the contact lenses. At the cartoning machine, a specially configured metal tower (not shown) is used to properly position and automatically feed the blister packages to the cartoning machine. Since the metal towers themselves are relatively expensive, it would be expensive to tie up many towers simply to store large quantities of blister packages prior to the time they are needed at the cartoning machine. The present invention thus provides a relatively inexpensive storage container for holding the blister packages between process stations. In this regard, container 10 may be made of a relatively inexpensive material as compared to the metal towers, such as cardboard and the like materials, for example. Also, although the discussion herein relates to a contact lens manufacturing environment and references specific process stations such as cartoning, it is understood that the invention is not to be so limited. Thus, the invention may be useful in other types of settings (manufacturing and otherwise) and/or between different types of work stations.

As seen in FIG. 1, bottom panel 14*e* includes a hole 15 positioned at the bottom of each column 20. Holes 15 are smaller than the outer dimensions of the blister package to be deposited in container 10 such that the blister package will not fall through the hole. Blister package dispenser 12 is used when it is time to transfer the blister packages from container 10 to another receptacle, such as the metal tower discussed above.

Dispenser 12 is seen to include a plate 11 which approximates the size and shape of bottom panel 14*e*. A number of push rods 13 are mounted to plate 11, extending normal thereto, with the number of push rods 13 equaling the number of columns 20 in container 10. Push rods 13 are also mounted to align with the holes 15 formed in bottom panel 14*e* whereby the top, free ends 13*a* of each push rod 13 may be inserted through a respective hole 15 with the push rods thereby entering container interior 16. As the push rods 13 are advanced further into interior 16, they engage the stacked blister packages and push them upwardly and out of the container through open top 21. In this manner, each column of stacked blister packages are dispensed from container 10 at the same time. The metal tower or other receptacle is provided with a column array substantially of the same number and arrangement as the array of columns in container 10. As such, the columns of the receptacle may be aligned with the columns 20 of container 20 at the open top of container 10 immediately prior to using dispenser 12. Thus, the blister packages may be quickly and efficiently transferred from container 10 to the metal tower or other receptacle as needed.

What is claimed is:

1. Apparatus for holding a plurality of stacked packages, said apparatus comprising:

a) a container having one or more side panels and a bottom panel defining an open top and an interior having one or more columns therein extending uninterrupted from said bottom panel to said open top and wherein said plurality of stacked packages may be placed for holding in said container; and b) a package dispenser having a plate and one or more push rods having a first end mounted to said plate in a generally normal orientation with respect thereto, and an opposite, free end;

whereby said dispenser may be engaged with said container by inserting said one or more push rods through a respective opening formed in said bottom panel, said push rod free end may engage said plurality of stacked packages placed in said column, whereby said push rods may be advanced in a respective said column toward said open top, said push rods operable to push said plurality of stacked packages in said column out of said container through said open top.

2. The apparatus of claim 1, and further comprising at least two of said columns formed in said container interior and at least two of said push rods mounted to said dispenser plate and each of said push rods positioned for alignment with a respective one of said at least two columns.

3. The apparatus of claim 2 and further comprising a hole formed in said bottom panel adjacent each column and wherethrough said push rod free end may be inserted into said container.

4. The apparatus of claim 1 wherein said container is formed of cardboard.

5. The apparatus of claim 1 and wherein said one or more columns comprises a plurality of discrete, parallel columns defined by a plurality of dividing panels positioned in said container interior.

6. The apparatus of claim 1 and further comprising a plurality of columns arranged in an array.

7. A method of storing a plurality of blister packages between manufacturing process stations, said method comprising the steps of:

a) providing a container having a bottom panel and one or more side panels defining an open top and an interior;

b) forming one or more columns in said container interior, said one or more columns extending uninterrupted from said bottom panel to said open top;

c) depositing a plurality of stacked blister packages in said one or more columns;

d) providing a package dispenser for dispensing said packages from said container, said package dispenser including one or more push rods for inserting through a respective opening formed in said bottom panel and into a respective column, said push rod operable to engage and push the stacked blister packages out of said container through said open top.

8. The method of claim 7 and further comprising the step of providing a secondary receptacle into which said blister packages are delivered directly from said container using said dispenser.

9. The method of claim 8 wherein said secondary receptacle is a metal tower used for feeding blister packages to a manufacturing process station.

10. The method of claim 9 wherein said process station is a cartoning machine.

11. The method of claim 9 wherein said container is formed of cardboard.

* * * * *